US011178488B2

(12) United States Patent
Watanabe et al.

(10) Patent No.: US 11,178,488 B2
(45) Date of Patent: Nov. 16, 2021

(54) ACOUSTIC DEVICE

(71) Applicant: Sony Corporation, Tokyo (JP)

(72) Inventors: Ryutaro Watanabe, Tokyo (JP); Toru Nakagawa, Chiba (JP); Tetsunori Itabashi, Kanagawa (JP); Shigetoshi Hayashi, Tokyo (JP); Toru Chinen, Kanagawa (JP); Asaya Hondo, Chiba (JP); Satoko Kitagawa, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 16/772,733

(22) PCT Filed: Dec. 10, 2018

(86) PCT No.: PCT/JP2018/045377

§ 371 (c)(1),
(2) Date: Jun. 12, 2020

(87) PCT Pub. No.: WO2019/124149

PCT Pub. Date: Jun. 27, 2019

(65) Prior Publication Data

US 2021/0227326 A1 Jul. 22, 2021

(30) Foreign Application Priority Data

Dec. 20, 2017 (JP) ..... JP2017-244549

(51) Int. Cl.

| | |
|---|---|
| ***H04R 5/02*** | (2006.01) |
| ***H04S 7/00*** | (2006.01) |
| ***H04R 1/02*** | (2006.01) |

(52) U.S. Cl.

CPC ..... *H04R 5/023* (2013.01); *H04R 1/025* (2013.01); *H04S 7/302* (2013.01); *H04R 2499/13* (2013.01)

(58) Field of Classification Search

CPC .... H04R 2499/13; H04R 5/023; H04R 1/025; H04S 7/302

(Continued)

(56) References Cited

U.S. PATENT DOCUMENTS 5,887,071 A 3/1999 House
7,440,578 B2 * 10/2008 Arai ..... B60N 2/879 381/302

(Continued)

FOREIGN PATENT DOCUMENTS

CN 102811406 A 12/2012
CN 105191348 A 12/2015

(Continued)

OTHER PUBLICATIONS

U.S. Appl. No. 16/959,793, filed Jul. 2, 2020, Hayashi et al.

(Continued)

*Primary Examiner* — Paul Kim

(74) *Attorney, Agent, or Firm* — Wolf, Greenfield & Sacks, P.C.

(57) ABSTRACT

The present invention is directed to reducing influence of crosstalk components by appropriately blocking a propagation path of the crosstalk components output from speakers that reproduce signals for right and left ears respectively. Provided is a contact member used in contact with a back and/or a back of a head of a listener. The contact member is installed with: a first speaker that reproduces a signal for the left ear and a second speaker that reproduces a signal for the right ear; and a propagation obstruction adapted to block a propagation path of crosstalk components output from the respective speakers.

9 Claims, 4 Drawing Sheets

(a)

(b)

(58) Field of Classification Search
USPC ..... 381/302
See application file for complete search history.

(56) References Cited

U.S. PATENT DOCUMENTS

| | | | |
|---|---|---|---|
| 8,483,413 | B2 | 7/2013 | Hartung et al. |
| 10,531,195 | B2 | 1/2020 | Vautin et al. |
| 2007/0116298 | A1 | 5/2007 | Holmi et al. |
| 2008/0273713 | A1 | 11/2008 | Hartung et al. |
| 2012/0008806 | A1 | 1/2012 | Hess |
| 2017/0013386 | A1 | 1/2017 | Vautin et al. |
| 2017/0053636 | A1 | 2/2017 | Oswald et al. |
| 2017/0096099 | A1 | 4/2017 | Matsubara et al. |
| 2018/0122355 | A1 | 5/2018 | Oswald et al. |
| 2019/0110152 | A1 | 4/2019 | Lam et al. |
| 2020/0374631 | A1 | 11/2020 | Hayashi et al. |

FOREIGN PATENT DOCUMENTS

| | | |
|---|---|---|
| CN | 105210391 A | 12/2015 |
| EP | 1 788 838 | 5/2007 |
| EP | 2 405 670 | 1/2012 |
| JP | 59-041158 | 3/1984 |
| JP | 08-19089 | 1/1996 |
| JP | 09-46788 | 2/1997 |
| JP | 2007-143164 | 6/2007 |
| JP | 2012-019506 A | 1/2012 |
| JP | 2017-071240 A | 4/2017 |
| WO | WO 2017/007665 | 1/2017 |
| WO | WO 2017/030920 | 2/2017 |

OTHER PUBLICATIONS

International Search Report and Written Opinion dated Mar. 12, 2019 in connection with International Application No. PCT/JP2018/045377, and English translation thereof.

International Search Report and Written Opinion dated Mar. 26, 2019 in connection with International Application No. PCT/JP2019/000602, and English translation thereof.

International Preliminary Report on Patentability dated Jul. 2, 2020 in connection with International Application No. PCT/JP2018/045377, and English translation thereof.

International Preliminary Report on Patentability dated Jul. 23, 2020 in connection with International Application No. PCT/JP2019/000602, and English translation thereof.

* cited by examiner

ACOUSTIC DEVICE

CROSS REFERENCE TO RELATED APPLICATIONS

This is a U.S. National Stage Application under 35 U.S.C. § 371, based on International Application No. PCT/JP2018/045377, filed Dec. 10, 2018, which claims priority to Japanese Patent Application JP 2017-244549, filed Dec. 20, 2017, each of which is hereby incorporated by reference in its entirety.

TECHNICAL FIELD

The present technology relates to an acoustic device and more specifically relates to an acoustic device that reduces influence of crosstalk components output from speakers that reproduce signals for right and left ears respectively.

BACKGROUND ART

There is a proposed stereophonic reproduction system (virtual surround-sound system) using speakers. This stereophonic reproduction system can virtually implement surround sounds with two speakers on right and left sides. Crosstalk cancellation is one of problems in implementing this stereophonic system.

Conventionally, crosstalk is canceled by signal processing, but there are problems that filter designing is difficult, an application area is limited, and furthermore, a calculation amount and a memory amount are expended. For such problems, it is conceivable to implement a system that is made unnecessary to perform crosstalk cancellation by the signal processing by installing an obstruction at a propagation path of a crosstalk component to physically prevent generation of crosstalk or attenuate the crosstalk component.

For example, Patent Document 1 discloses a technology in which a partition plate for crosstalk prevention is provided between right and left speakers installed at a ceiling surface. In this technology, the right and left speakers and the partition plate for crosstalk prevention are installed at the ceiling surface, there is a gap between a listener and the partition plate, and it is difficult to appropriately block a propagation path of a crosstalk component.

CITATION LIST

Patent Document

Patent Document 1: Japanese Patent Application Laid-Open No. 2008-271600

SUMMARY OF THE INVENTION

Problems to be Solved by the Invention

The present technology is directed to reducing influence of crosstalk components by appropriately blocking a propagation path of the crosstalk components output from speakers that reproduce signals for right and left ears respectively.

Solutions to Problems

A concept of the present technology is an acoustic device including a contact member used in contact with a back and/or a back of a head of a listener, in which the contact member is installed with:

a first speaker that reproduces at least one or more signals for a left ear and a second speaker that reproduces at least one or more signals of a right ear; and a propagation obstruction adapted to block a propagation path of crosstalk components output from the first speaker and the second speaker.

The present technology includes the contact member used in contact with the back and/or the back of the head of the listener. In the contact member, the first speaker that reproduces a signal for the left ear and the second speaker that reproduces a signal for the right ear are installed, and the propagation obstruction is installed so as to block the propagation path of the crosstalk components output from the first speaker and the second speaker.

For example, the propagation obstruction may include a sound-absorbing material. In this case, since the crosstalk components output from the first speaker and the second speaker are absorbed by the propagation obstruction, the crosstalk components can be efficiently obstructed. Furthermore, for example, the propagation obstruction may include a shape fitting material. In this case, the propagation obstruction is deformed into a shape along the back or the back of the head of the listener or along the back portion of the neck from the back of the head to the back in accordance with a contact state while the back or the back of the head of the listener is in contact with the contact member, and therefore, it is possible to efficiently obstruct the crosstalk components output from the first speaker and the second speaker.

For example, the contact member may include one member, and the first speaker, the second speaker, and the propagation obstruction may be installed at the one member. In this case, for example, the one member may include a seat or a headrest. Furthermore, for example, the contact member is formed by connecting two members, and the first speaker and the second speaker are installed at one of the two members, and the propagation obstruction is installed at the other member of the two members. In this case, for example, the two members may include a seat and a headrest.

Thus, in the present technology, the first speaker that reproduces a signal for the left ear and the second speaker that reproduces a signal for the right ear are installed at the contact member used in contact with the back and/or the back of the head of the listener, and the propagation obstruction is installed so as to block the propagation path of the crosstalk components output from the speakers. Therefore, since the present technology is used in a state without having a gap between the listener and the propagation obstruction, influence of the crosstalk components can be reduced by appropriately blocking the propagation path of the crosstalk components output from the respective speakers.

Note that, in the present technology, the propagation obstruction may be installed at the contact member in a manner such that a position of the propagation obstruction can be adjusted, for example. In this case, for example, the position of the propagation obstruction may be adjustable at least in a first direction along the contact member, a second direction substantially perpendicular to the first direction, or a third direction connecting the first speaker and the second speaker. Thus, since the propagation obstruction is installed at the contact member in a manner such that the position thereof can be adjusted, the position of the propagation obstruction can be adjusted in accordance with a contact position of the back or the back of the head of the listener with respect to the contact member, and the propagation path of the crosstalk components output from the respective speakers can be appropriately blocked.

Furthermore, for example, the propagation obstruction may be detachably installed at the contact member in the present technology. With this configuration, replacement work can be easily performed in a case where the propagation obstruction becomes dirty or the like. Note that the propagation obstruction may have a shape separate from the contact member or a shape integrated therewith.

Effects of the Invention

According to the present technology, it is possible to reduce the influence of the crosstalk components by appropriately blocking the propagation path of the crosstalk components output from the speakers that reproduce signals for the right and left ears respectively. Note that the effects recited herein are not constantly limited and may be any one of the effects recited in the present disclosure.

MODE FOR CARRYING OUT THE INVENTION

Hereinafter, modes for carrying out the invention (hereinafter referred to as an "embodiment") will be described. Note that the description will be provided in the following order.

1. Embodiment
2. Modified Examples

1. EMBODIMENT

[Acoustic Device]

Figure 1:
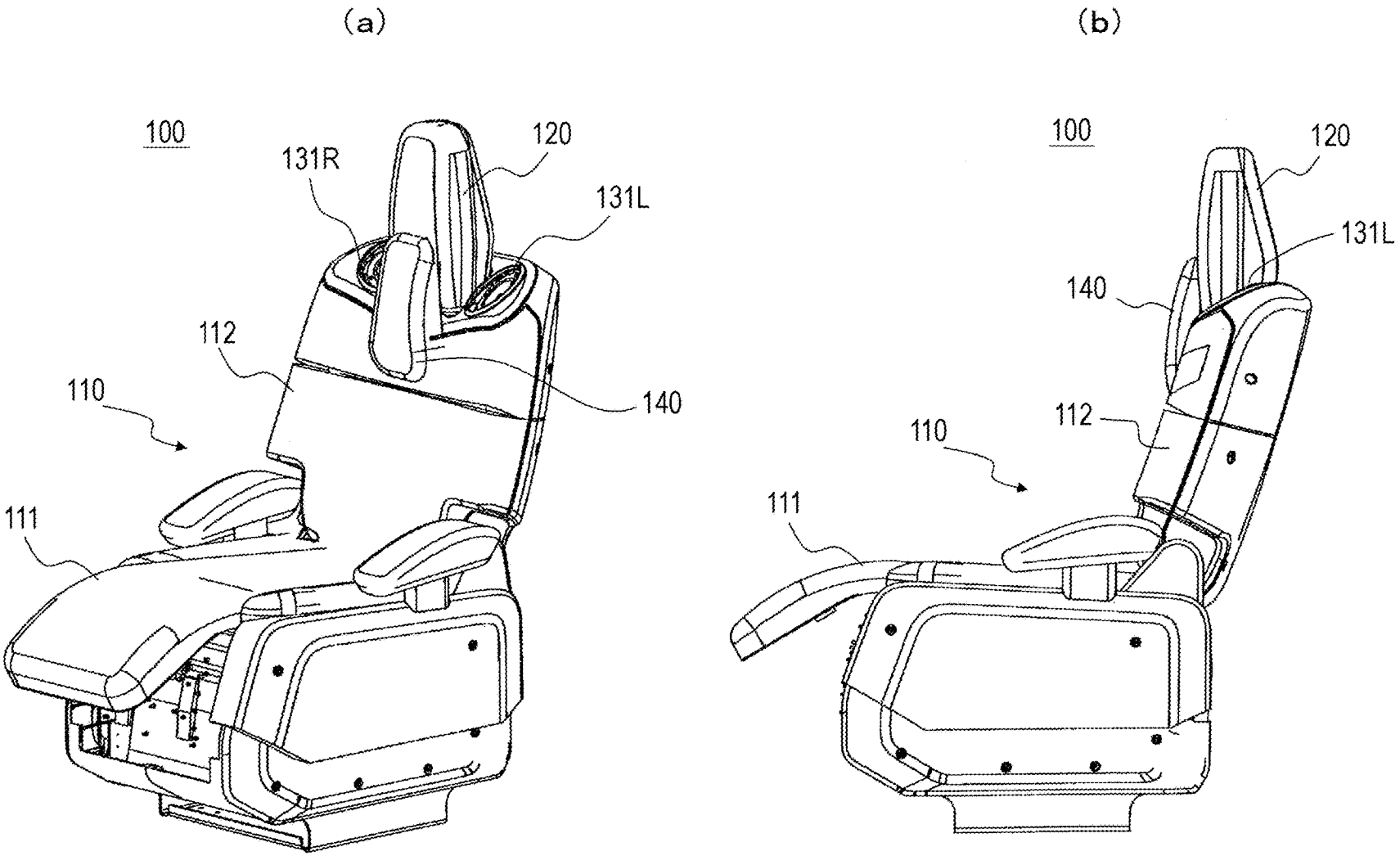
FIG. 1 provides a perspective view and a side view illustrating an exemplary configuration of an acoustic device as an embodiment.

FIGS. 1(*a*) and (*b*) illustrate an exemplary configuration of an acoustic device 100 as an embodiment. The acoustic device 100 is built inside a vehicle, for example, and includes a seat 110 and a headrest 120. The seat 110 includes a seat portion 111 and a backrest portion 112. The headrest 120 is detachably attached to an upper center position of the backrest portion 112 of the seat 110.

Furthermore, speakers 131L and 131R are installed at an upper portion of the backrest portion 112 of the seat 110 and on both sides of the headrest 120 while setting the attachment position of the headrest as a center. Here, the speakers 131L and 131R constitute a stereophonic reproduction system (virtual surround-sound system), the speaker 131L is a speaker that reproduces a signal for the left ear, and the speaker 131R is a speaker that reproduces a signal for the right ear. Note that, in this example, an example including one speaker that reproduces a signal for the left ear and one speaker that reproduces a signal for the right ear respectively are illustrated, but a plurality of speakers may be installed as for each of the speakers.

A signal for the left ear is supplied to the speaker 131L from a signal processing device (not illustrated) constituting the stereophonic reproduction system (virtual surround-sound system) and reproduced, and a sound (sound wave) corresponding to the signal for the left ear is output from the speaker 131L. Furthermore, a signal for the right ear is supplied to the speaker 131R from the signal processing device and reproduced, and a sound (sound wave) corresponding to the signal for the right ear is output from the speaker 131R.

Figure 2:
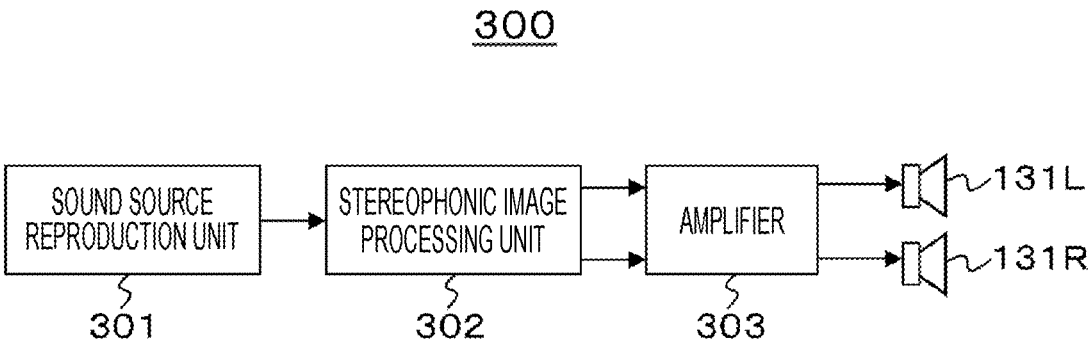
FIG. 2 is a block diagram illustrating an exemplary configuration of a signal processing device in a stereophonic reproduction system (virtual surround-sound system).

FIG. 2 illustrates an exemplary configuration of a signal processing device 300 in a stereophonic reproduction system (virtual surround-sound system). The signal processing device 300 includes a sound source reproduction unit 301, a stereophonic image processing unit 302, and an amplifier 303. The power source reproduction unit 301 reproduces, for example, audio signals of five channels, seven channels, and the like constituting surround-sound audio signals. The audio signals of the respective channels are supplied to the stereophonic image processing unit 302.

In the stereophonic image processing unit 302, virtual sound image localization processing is applied to the audio signals of the respective channels to generate a signal for the left ear and a signal for the right ear. The signal for the left ear obtained at the stereophonic image processing unit 302 is amplified at the amplifier 303 and supplied to the speaker 131L. Furthermore, the signal for the right ear obtained at the stereophonic image processing unit 302 is amplified at the amplifier 303 and supplied to the speaker 131R.

Figure 3:
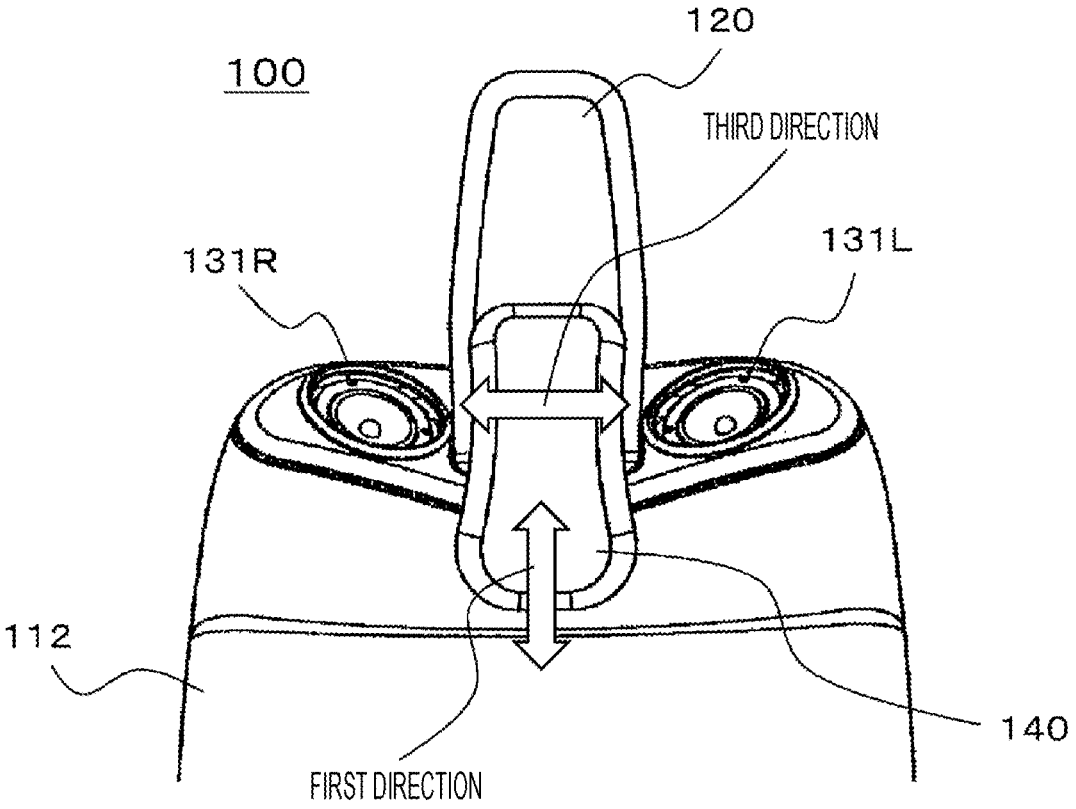
FIG. 3 is a view to describe a fact that a propagation obstruction is installed in a manner such that a position of the propagation obstruction can be adjusted.

Returning to FIG. 1, a propagation obstruction 140 is installed at the headrest 120 so as to block a propagation path of crosstalk components output from the speaker 131L and the speaker 131R. Here, as a propagation path of crosstalk, a periphery of a head and the like of a listener may be adopted in addition to a back portion of a neck of the listener, and a distance of the propagation path is shortest in the back portion of the neck. The propagation obstruction 140 may block the entire propagation path of the crosstalk components output from the speaker 131L and the speaker 131R, or may block only at least the path of the back of the neck where attenuation of the crosstalk components is relatively small and the mentioned shortest distance is formed. Note that an entire space of the back of the neck may be blocked or only a part thereof may be blocked at the time of blocking the back portion of the neck. As indicated by arrows in FIGS. 3 and 4, this propagation obstruction 140 is installed in a manner such that a position thereof can be adjusted in a direction (first direction) along the seat where the speaker 131L and the speaker 131R are installed.

Figure 4:
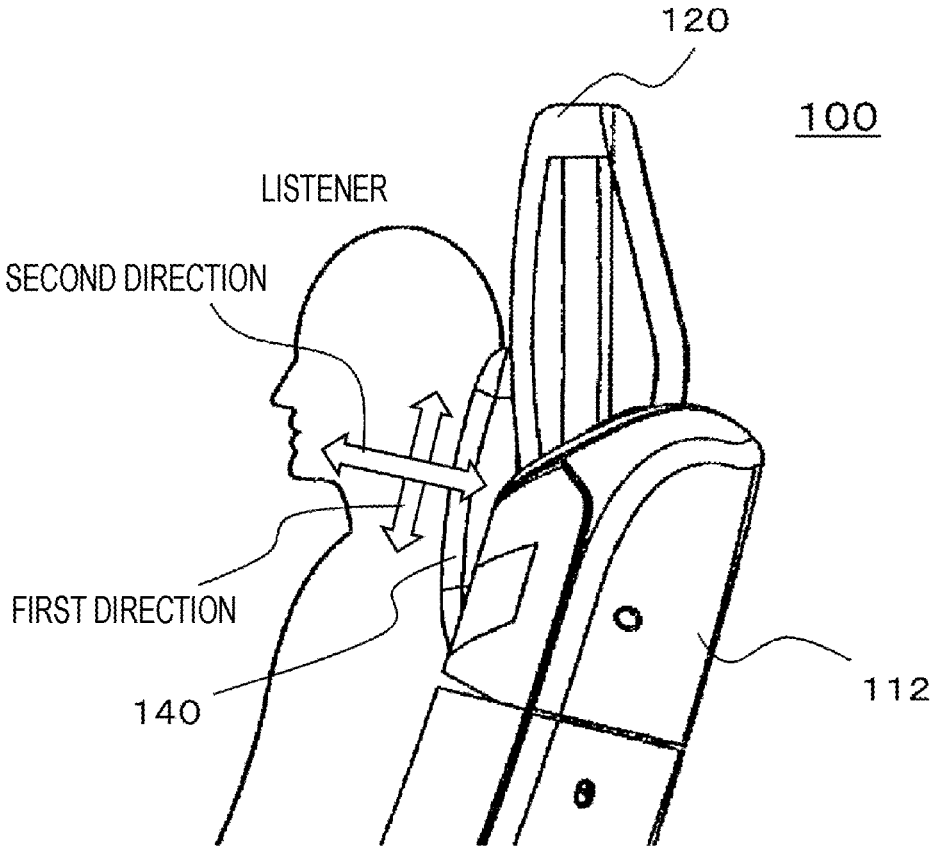
FIG. 4 is a view to describe a fact that the propagation obstruction includes a shape fitting material.

Note that, as for the direction in which the position can be adjusted, it is also conceivable that the position can be adjusted not only in the first direction but also in a horizontal direction substantially perpendicular to the first direction, a so-called front-rear direction (second direction) with respect to the seat (or the listener) as indicated by the arrows in FIG. 4. Furthermore, as indicated by the arrows in FIG. 3, the position may be adjustable in a direction connecting the speakers 131L and 131R, a so-called crosswise direction (third direction) for the listener. Since the position can be thus adjusted, the position of the propagation obstruction 140 can be adjusted in accordance with a contact position of the back or the back of the head of the listener with respect to the contact member, and the propagation path of the crosstalk components output from the respective speakers can be appropriately blocked. Furthermore, the propagation obstruction 140 may be detachably installed at the headrest 120. With this configuration, replacement work can be easily performed in a case where the propagation obstruction 140 becomes dirty or the like.

For example, to adjust the position of the propagation obstruction 140 in the two-axial directions including the vertical direction and the horizontal direction described above, the position can be appropriately adjusted in the first to third directions by applying: a known technology using a slider structure capable of two-axial movement/fixation in order to fix, for example, a camera to a tripod; or a known technology capable of two-axial movement/fixation by connecting a tip of a vertically-extendable pole to a pole whose position is adjustable in a crosswise direction. Besides, known technologies such as Velcro, a belt, a fastener, and a button can also be used to make the position of the propagation obstruction 140 adjustable in the first to third directions. In addition, of course, it is also possible to achieve the position adjustment by using a structure that performs movement, rotation, and revolving in triaxial directions. Since a mechanism/structure capable of performing adjustment in the triaxial directions referred to herein is a known technology, a description thereof will be omitted.

The propagation obstruction 140 includes, for example, a sound-absorbing material such as glass wool and Thinsulate. Since the sound-absorbing material is thus included, the crosstalk components output from the speakers 131L and 131R are absorbed by the propagation obstruction 140, and therefore, the crosstalk components can be efficiently obstructed.

Furthermore, the propagation obstruction 140 includes, for example, a low resilience material such as urethane, or a shape fitting material such as beads. Since the shape fitting material is thus included, as illustrated in FIG. 4, the propagation obstruction is deformed into a shape along the back or the back of the head of the listener or along the back portion of the neck from the back of the head to the back in accordance with a contact state while the back or the back of the head of the listener is in contact with the contact member, and therefore, the crosstalk components output from the speakers 131L and 131R can be efficiently obstructed.

As described above, in the acoustic device 100 illustrated in FIG. 1, the speaker 131L that reproduces a signal for the left ear and the speaker 131R that reproduces a signal for the right ear are installed at the contact member (the seat 110, the headrest 120) used in contact with the back and/or the back of the head of the listener, and the propagation obstruction 140 is installed so as to block the propagation path of the crosstalk components output from the speakers 131L and 131R.

Therefore, since the acoustic device is used in a state without having as gap between the listener and the propagation obstruction 140 (see FIG. 4), influence of the crosstalk components can be reduced by appropriately blocking the propagation path of the crosstalk components output from the respective speakers, and it is possible to provide an environment for excellent stereophonic reproduction. Note that it is preferable to achieve a state without having a gap between the listener and the propagation obstruction 140, but even when there is a slight gap between the listener and the propagation obstruction 140, it goes without saying that the effects of the present invention can be exerted.

Note that, among sound waves output from the speakers, what significantly involves the sound image localization is a high-frequency component, and the high-frequency component has a high rectilinear propagation property. Therefore, as an installation position of the propagation obstruction 140, it is also possible to select, instead of the shortest path, a path having a high rectilinear propagation property out of propagation paths of crosstalk.

2. MODIFIED EXAMPLES

Figure 5:
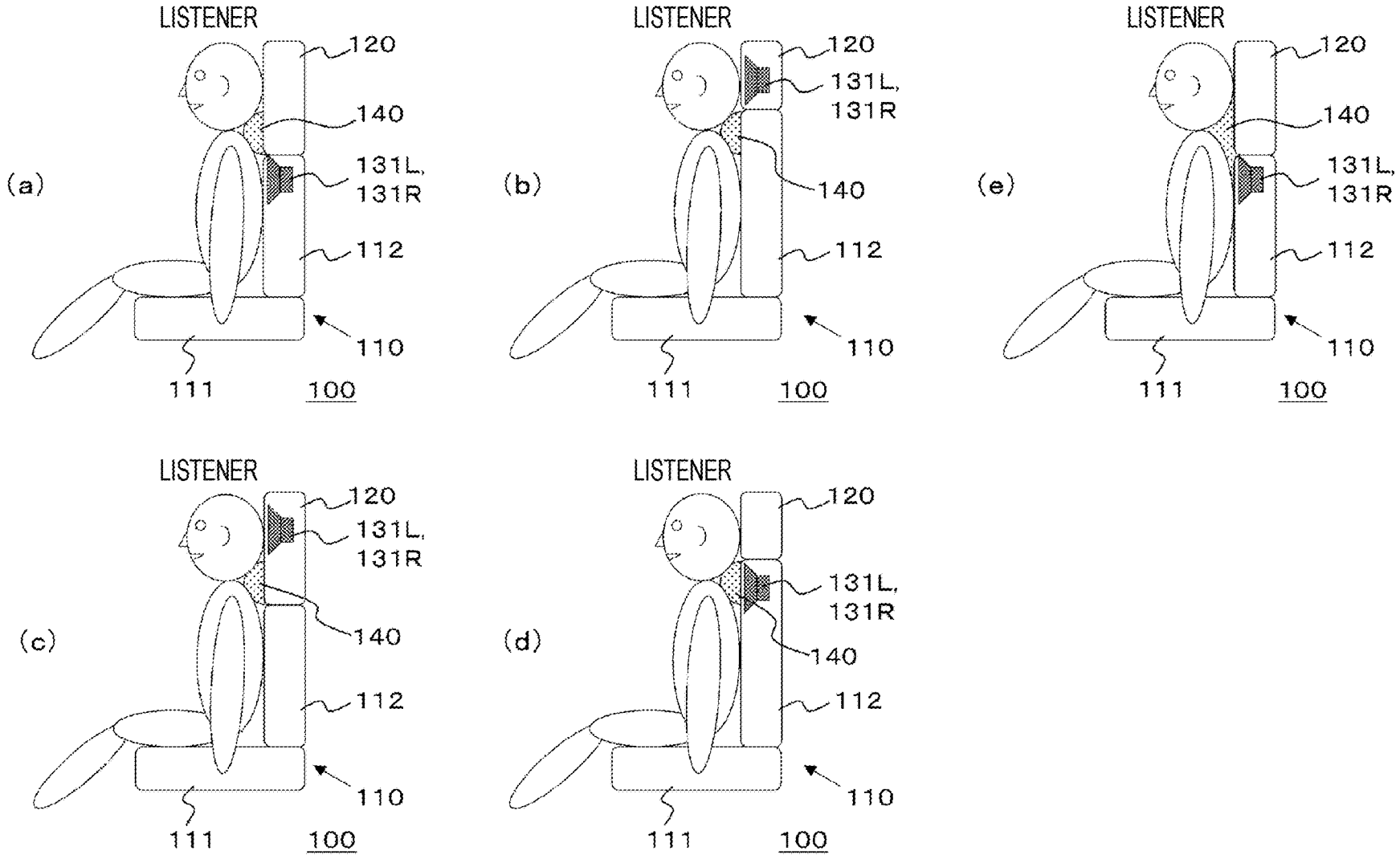
FIG. 5 provides views to describe other exemplary installation places of speakers and the propagation obstruction.

In the above-described embodiment, note that the example of installing the speakers 131L and 131R at the backrest portion 112 of the seat 110 and installing the propagation obstruction 140 at the headrest 120 has been described as illustrated in FIG. 5(*a*). However, as illustrated in FIG. 5(*b*), it is also conceivable to install the speakers 131L and 131R at the headrest 120 and install the propagation obstruction 140 at the backrest portion 112 of the seat 110.

Furthermore, as illustrated in FIG. 5(*c*), it is also conceivable to install both the speakers 131L, 131R and the propagation obstruction 140 at the headrest 120. Moreover, as illustrated in FIG. 5(*d*), it is also conceivable to install both the speakers 131L, 131R and the propagation obstruction 140 at the backrest portion 112 of the seat 110.

Note that FIGS. 5(*a*) to (*d*) illustrate the examples in which the propagation obstruction 140 does not interrupt an entire back of a neck of a listener, that is, there is a slight gap between the listener and the propagation obstruction 140, but as illustrated in FIG. 5(*e*), the propagation obstruction 140 may interrupt the entire back of the neck of the listener. Note that FIG. 5(*e*) corresponds to FIG. 5(*a*), but those corresponding to FIGS. 5(*b*) to (*d*) can also have the similar configuration in which the propagation obstruction 140 interrupts the entire back of the neck of the listener.

Furthermore, in the above-described embodiment, the configuration in which the acoustic device 100 is built inside a vehicle has been described, but a technology similar to the acoustic device 100 is applicable to a sound system in a house, an accommodation facility, or further in an amusement park, a game center, or the like.

Furthermore, in the above-described embodiment, the example of installing the speakers 131L, 131R and the propagation obstruction 140 at the backrest 112 of the seat 110 and the headrest 120 has been described, but it is also conceivable to similarly install these components at a contact member such as a bed, a sofa, or a rucksack used in contact with the back and/or the back of the head of the listener, for example.

Furthermore, in the above-described embodiment, the example in which the propagation obstruction 140 is installed at the backrest portion 112 of the seat 110 or the headrest 120, and has a shape separated from these components has been illustrated. However, it is also conceivable to have a configuration in which the propagation obstruction has a shape integrated with the contact member.

Furthermore, the present technology can adopt following configurations as well.

(1) An acoustic device including a contact member used in contact with a back and/or a back of a head of a listener, in which the contact member is installed with:

a first speaker that reproduces at least one or more signals for a left ear and a second speaker that reproduces at least one or more signals of a right ear; and a propagation obstruction adapted to block a propagation path of crosstalk components output from the first speaker and the second speaker.

(2) The acoustic device recited in (1) above, in which the contact member includes one member, and the first speaker, the second speaker, and the propagation obstruction are installed at the one member.

(3) The acoustic device recited in (2) above, in which the one member includes a seat or a headrest.

(4) The acoustic device recited in (1) above, in which the contact member is formed by connecting two members, and the first speaker and the second speaker are installed at one of the two members, and the propagation obstruction is installed at the other member of the two members.

(5) The acoustic device recited in (4) above, in which the two members include the seat and the headrest.

(6) The acoustic device recited in any one of (1) to (5) above, in which the propagation obstruction is installed at the contact member in a manner such that a position of the propagation obstruction can be adjusted.

(7) The acoustic device recited in (6) above, in which the position of the propagation obstruction can be adjusted at least in a first direction along the contact member, a second direction substantially perpendicular to the first direction, or a third direction connecting the first speaker and the second speaker.

(8) The acoustic device recited in any one of (1) to (7) above, in which the propagation obstruction is detachably installed at the contact member.

(9) The acoustic device recited in any one of (1) to (8) above, in which the propagation obstruction includes a sound-absorbing material.

(10) The acoustic device recited in any one of (1) to (9) above, in which the propagation obstruction includes a shape fitting material.

(11) The acoustic device recited in any one of (1) to (10) above, in which the propagation obstruction has a shape integrated with the contact member.

REFERENCE SIGNS LIST

100 Acoustic device
110 Seat
111 Seat portion
112 Backrest portion
120 Headrest
131L, 131R Speaker
140 Propagation obstruction
300 Signal processing device
301 Sound source reproduction unit
302 Body sound image processing unit
303 Amplifier

The invention claimed is:

1. An acoustic device comprising a contact member used in contact with a back and/or a back of a head of a listener, wherein the contact member is installed with:

a first speaker configured to reproduce at least one or more signals for a left ear and a second speaker configured to reproduces at least one or more signals of a right ear; and a propagation obstruction configured to block a propagation path of crosstalk: components output from the first speaker and the second speaker, wherein the propagation obstruction is installed at the contact member in a manner such that a position of the propagation obstruction can be adjusted, and the position of the propagation obstruction can be adjusted at least in a first direction along the contact member, a second direction substantially perpendicular to the first direction, or a third direction connecting the first speaker and the second speaker.

2. The acoustic device according to claim 1, wherein the contact member includes one member, and the first speaker, the second speaker, and the propagation obstruction are installed at the one member.

3. The acoustic device according to claim 2, wherein the one member includes a seat or a headrest.

4. The acoustic device according to claim 1, wherein the contact member is formed by connecting two members, and the first speaker and the second speaker are installed at one of the two members, and the propagation obstruction is installed at another member of the two members.

5. The acoustic device according to claim 4, wherein the two members include the seat and the headrest.

6. The acoustic device according to claim 1, wherein the propagation obstruction is detachably installed at the contact member.

7. The acoustic device according to claim 1, wherein the propagation obstruction includes a sound-absorbing material.

8. The acoustic device according to claim 1, wherein the propagation obstruction includes a shape fitting material.

9. The acoustic device according to claim 1, wherein the propagation obstruction has a shape integrated with the contact member.

* * * * *